United States Patent [19]

Nilsson et al.

[11] 4,446,930

[45] May 8, 1984

[54] DRILL STEEL REMOVAL ATTACHMENT FOR ROCK DRILLING MACHINE

[75] Inventors: Hans Gösta Nilsson; Kurt A. G. Nilsson, both of Tyresö, Sweden

[73] Assignee: Atlas Copco Aktiebolag, Nacka, Sweden

[21] Appl. No.: 436,397

[22] Filed: Oct. 25, 1982

[30] Foreign Application Priority Data

Nov. 26, 1981 [SE] Sweden ..... 8107060

[51] Int. Cl.[3] ..... B25D 17/00

[52] U.S. Cl. ..... 173/29; 173/91; 173/132

[58] Field of Search ..... 173/29, 91, 118, 129, 173/132, 133, 134

[56] References Cited

U.S. PATENT DOCUMENTS

| | | | |
|---|---|---|---|
| 1,102,652 | 7/1914 | Gibb et al. | 173/132 |
| 1,173,996 | 2/1916 | Bull | 173/134 |
| 2,844,007 | 7/1958 | Morehead | 173/132 |
| 3,008,528 | 11/1961 | Berthet et al. | 173/133 |
| 3,109,500 | 11/1963 | Glawon | 173/132 |
| 3,651,873 | 3/1972 | Uebel et al. | 173/29 |

FOREIGN PATENT DOCUMENTS

| | | | |
|---|---|---|---|
| 1,198,763 | 8/1965 | Fed. Rep. of Germany | 173/29 |
| 434097 | 5/1934 | United Kingdom | 173/91 |

*Primary Examiner*—Frank T. Yost
*Assistant Examiner*—Hien H. Phan
*Attorney, Agent, or Firm*—Frishauf, Holtz, Goodman & Woodward

[57] ABSTRACT

An attachment (15) for a percussive rock drilling machine (12) for withdrawing a drill steel from a drilled hole. The drilling machine is of the kind which is displaceable along a feed beam (14) by a feeding motor. The attachment (15) comprises a spring housing (17) which contains a compressive spring (22) and a stopping member (23), the housing being suspended by flexible means (26, 27) from a yoke-shaped member (18) coupled on to the drilling machine body (19). The stopping member (23) is arranged to abut against a coupling sleeve (32) or the like on the drill steel (16). When retracting the drilling machine (12) by the feeding motorand starting the ordinary percussive action, the impacts directed downwards will be transformed to impacts directed upwards which loosen and withdraw the stuck drill steel (16) from the drilled hole.

9 Claims, 4 Drawing Figures

DRILL STEEL REMOVAL ATTACHMENT FOR ROCK DRILLING MACHINE

BACKGROUND OF THE INVENTION

This invention relates to an attachment for a percussive rock drilling machine of the kind being displaceable along a feed beam by a feeding device, said attachment being arranged for during applied rearward feed force withdraw drill steels which are stuck in the drilled hole.

A frequently appearing problem in rock drilling is that the drill steel or the drill string gets stuck in the drilled hole, for example due to loose material falling from the sides of the hole and wedging the drill bit. Quite often the withdrawing power of the feeding device is unsufficient to loosen the drill steel, and the steel is usually left in the hole. Withdrawing the drill steel by jacks applied between the drill steel and the rock surface is mostly not successful since the drill steel or the drill bit or both of them get damaged by the lifting action. A better result is achieved by using specially made percussive machines which are coupled on to the drilling rig in use. Machines of that kind comprise an impact motor adapted to force out the drill steel from the drill hole by impacts, i.e. in principal a percussive drilling machine striking upwards instead of downwards. Such machines are, however, too expensive to have in store only for this exceptional use and are difficult to couple on to the feed beam and power system of the equipment in use.

One object of the present invention is therefore to provide a simple and economical attachment for withdrawing stuck drill steels, which attachment easily can be coupled on to the drilling machine in use when the drill steel is stuck. Another object is to make it possible to use the impact motor of the drilling machine for loosening the drill steel. A further object is to transform the impacts of said impact motor to pulling pulses acting on the drill steel. These objects and others are achieved by providing an attachment according to the present invention, as claimed.

DETAILED DESCRIPTION

Figure 1:
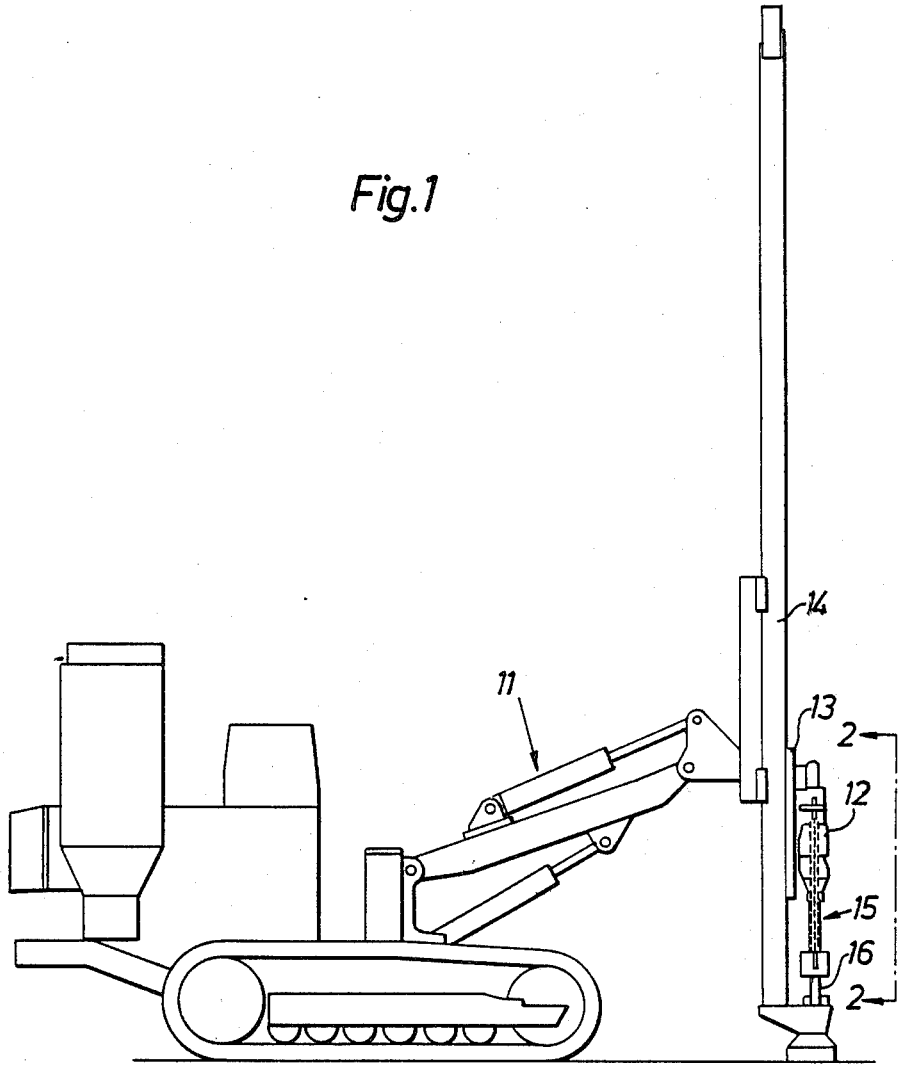
FIG. 1 is a side view of a drilling rig with a rock drilling machine having a pulling attachment according to the invention.
Figure 2:
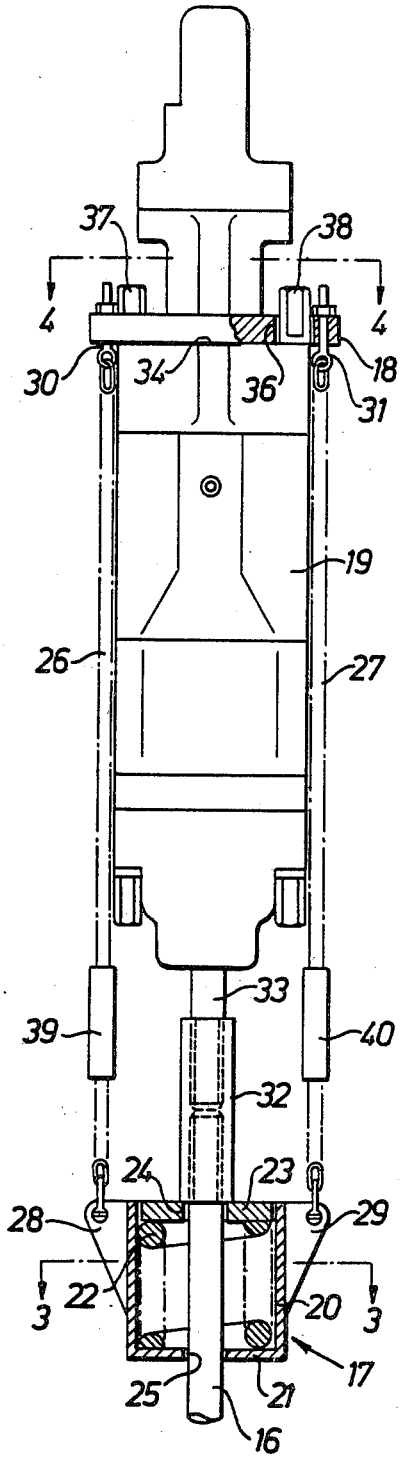
FIG. 2 is a fragmentary view partly in section of the drilling machine and the pulling attachment as indicated by the line 2—2 in FIG. 1.
Figure 4:
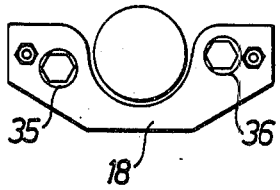
FIG. 4 is a cross section taken along the line 4—4 in FIG. 2.
Figure 3:
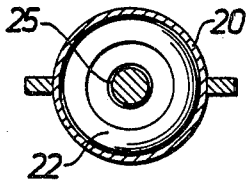
FIG. 3 is a cross section taken along the line 3—3 FIG. 2.

A crawler-tracked drilling unit 11 for overburden drilling is shown in FIG. 1. The unit 11 comprises a rock drilling machine 12 mounted to a cradle 13 which is movable along a feed beam 14 by a feeding device, not shown. The machine 12 is provided with an attachment 15 for withdrawing a drill steel 16 which is stuck in the drilled hole. The attachment 15 comprises a spring housing 17 which is suspended from a yoke-shaped member 18 carried by the machine body 19. The spring housing 17 has a cylindrical wall 20 and an annular bottom 21 adapted for supporting a helical spring 22 within the housing 17. A stopping member 23 guided by the wall 20 is resting on said spring 22. Said member 23 and the bottom 21 have central holes 24 and 25 respectively somewhat bigger than the cross section of the drill steel 16 in order to enable free motion therealong. The housing 17 is suspended from said yoke-shaped member 18 by means of two chains 26, 27 arranged in pairs one on each side of the machine body 19. The chains 26, 27 extend between lugs 28, 29 welded to the cylindrical wall 20 and ring bolts 30, 31 secured to the yoke-shaped member 18. The length of each chain 26, 27 is adjusted in order to place the housing 17 immediately under the coupling sleeve 32 between the shank adapter 33 of the drilling machine 12 and the drill steel 16. The member 18 is adapted to fit on a suitable shoulder 34 on the machine body 19 and is provided with two holes 35, 36 which are large enough to enclose side bolts 37, 38 included in the drilling machine. By the above arrangement the yoke-shaped member 18 is easy to put over the bolts 37, 38 in order to take its working position without any need for additional locking means. The member 18 must of course be adapted to the particular drilling machine in use, so it might be preferred in some cases to permanently attach said member 18 to the machine body 19 and instead provide for suitable releasable locking means between the chains 26, 27 and the member 18. It might also be preferred to arrange a spanner means 39, 40 on each chain, as shown schematically in FIG. 2. Preferably said spanner means 39, 40 is a toggle lock which in its locked position gives the chain 26, 27 the right length for placing the stopping member 23 against the coupling sleeve 32 and in its released position lengthens the chain 26, 27 for disengaging the member 23. In said released position the drilling machine 12 can be used for normal drilling with the spring housing 17 still hanging under the machine body 19.

When a drill steel, normally an extension drill steel comprising one or more extension rods is stuck in the hole drilled, first the shank adapter 33 and the mating rod or steel 16 are separated from each other by loosening the steel 16 from the coupling sleeve 32. Then the yoke-shaped member 18 is put in its working position on the machine body 19 which is lifted somewhat in order to make room for the spring housing 17 between the rod end and the sleeve 32. After that the machine body 19 is lowered again and the spring housing 17 is slipped on the projecting end of the drill steel 16. Finally the adapter 33 with the sleeve 32 is rotated for rejoining the drill steel 16 therewith. Now the stopping member 23 is facing the downward end of the sleeve 32 and the drill-puller arrangement is ready for operation. By the use of said spanner means 39, 40 the above operation can be a little simplified since the spring housing 17 will be easier to handle and put in position with the chains 26, 27 extended.

For withdrawing the stuck drill steel the feeding device is actuated to retract the drilling machine 12 which compresses the helical spring 22 to a suitable extent. For example when applying a pulling force of 3 tons the spring 22 is preferably compressed 3–4 percent. Then the impact motor of the drilling machine 12 is started, transferring compressive shock waves to the drill steel 16. By each one of said waves the adapter 33 and the sleeve 32 are pushed downwards bringing a further momentary compression to the spring 22 and since the drill bit does not abut the bottom of the drill hole, at least not under feeding power, the compressive shock wave cannot deliver its energy to the rock but returns with most of its energy as a tensile reflected shock wave which in addition to the energy stored in the spring 22 causes a pulling reflex on the drill steel.

The attachment 15 will thus transform the ordinary percussive action directed downwards to impacts directed upwards which loosen and withdraw the stuck drill steel. When the withdrawal is finished the attachment is preferably removed from the drilling machine 12 so as not to be in the way during handling and feeding. After removal of the attachment the machine is ready for continued normal drilling while the attachment is available for use on other drilling machines.

It is to be noted that the invention is not limited to the described example but can be varied in many ways within the scope of the claims.

We claim:

1. Drill steel withdrawing attachment for a percussive rock drilling machine (12) of the kind which is displaceable along a feed beam (14) by a feeding device, said drill steel withdrawing attachment being arranged for applying a rearward feed force to drill steels to withdraw drill steels (16) which are stuck in a drilled hole, the drill steel withdrawing attachment comprising:

a spring housing (17);

a flexible means (26,27) coupled to said spring housing (17) for movably suspending said spring housing (17) from the drilling machine (12) with said spring housing in front of said drilling machine (12) such that said drill steel (16) passes through said spring housing (17);

a compression spring (22) located in said spring housing (17); and a stopping member (23) coupled to said spring housing (17) and acting as a reflector for the blows of the drilling machine (12), said stopping member (23) being supported by said spring (22) in said spring housing (17) so as to be in an abutment position against the drill steel (16) via an extension sleeve (32) or the like on said drill steel (16).

2. Attachment according to claim 1, wherein said compression spring (22) is a helical spring adapted for encircling said drill steel (16).

3. Attachment according to claim 1 or 2, further comprising coupling means (18) for releasably fixing said flexible means to said drilling machine.

4. Attachment according to claim 3, wherein said coupling means comprises a yoke-shaped member (18) attached to said flexible means (26, 27) and adapted to be carried by a body portion (19) of said drilling machine (12).

5. Attachment according to claim 4, wherein said flexible means (27) comprises two chains (26, 27) arranged in pairs between said yoke-shaped member (18) and said spring housing (17).

6. Attachment according to claim 5, comprising a toggle lock (39, 40) coupled to each of said chains (26, 27), each of said toggle locks (39, 40) having a locked position in which it puts said stopping member (23) into said abutting position.

7. Attachment according to claim 4, further comprising a toggle lock (39, 40) coupled to said flexible means (26, 27), said toggle lock (39, 40) having a locked position in which it puts said stopping member (23) into said abutting position.

8. Attachment according to claim 1, wherein said spring housing (17) comprises a cylindrical wall (20) and an annular bottom (21) for carrying said compression spring (22).

9. Attachment according to claim 1, further comprising a toggle lock (39, 40) coupled to said flexible means (26, 27), said toggle lock (39, 40) having a locked position in which it puts said stopping member (23) into said abutting position.

* * * * *